United States Patent [19]

Dodds

[11] 4,388,602

[45] Jun. 14, 1983

[54] ELECTRON BEAM INFLUENCING APPARATUS INCORPORATING VERTICAL BEAM MOVEMENT FUNCTION

[75] Inventor: Dennis L. Dodds, Indianapolis, Ind.

[73] Assignee: RCA Corporation, New York, N.Y.

[21] Appl. No.: 303,476

[22] Filed: Sep. 18, 1981

[51] Int. Cl.[3] ..... H01F 1/00

[52] U.S. Cl. ..... 335/212

[58] Field of Search ..... 335/210, 212, 284

[56] References Cited

U.S. PATENT DOCUMENTS

| | | | |
|---|---|---|---|
| 3,898,597 | 8/1975 | Vonk | 335/212 |
| 4,105,983 | 8/1978 | Barten et al. | 335/212 |
| 4,159,456 | 6/1979 | Smith | 335/284 |
| 4,162,470 | 7/1979 | Smith | 335/284 |
| 4,232,283 | 11/1980 | Werst | 335/212 |
| 4,295,110 | 10/1981 | Uesaka et al. | 335/284 |

*Primary Examiner*—George Harris

*Attorney, Agent, or Firm*—Eugene M. Whitacre; Paul J. Rasmussen; Scott J. Stevens

[57] ABSTRACT

A strip or sheath-type beam bender providing purity and static convergence correction for an in-line color kinescope further includes a pair of oppositely polarized magnetic regions or zones on opposite sides of the kinescope neck and aligned with a plane passing through the horizontal beam axis in order to provide vertical beam movement. In order to conserve material, the beam movement zones may be located between purity correcting magnetized zones in the same longitudinal plane of the beam bender.

4 Claims, 4 Drawing Figures

ELECTRON BEAM INFLUENCING APPARATUS INCORPORATING VERTICAL BEAM MOVEMENT FUNCTION

This invention relates to purity and static convergence adjustments for color kinescopes and in particular to purity and convergence adjustment apparatus comprising strip-type beam benders having locally magnetized zones.

BACKGROUND OF THE INVENTION

Television receiver kinescopes having an electron gun assembly which produces horizontally aligned electron beams may be combined with a deflection yoke which can substantially converge the electron beam at all points on the kinescope display screen without the need for dynamic convergence circuitry. The deflection yoke of this self-converging display system produces horizontal and vertical deflection fields having nonuniform distributions which act on the spatially separated beams with field components having different strengths and orientations in order to converge the beams. The necessary field nonuniformity required for convergence can be determined by a mathematical analysis using third order abberation theory. It can be determined from this analysis that the vertical deflection field must have a nonuniformity function which produces a barrel-shaped field, while the horizontal deflection field must be pincushion-shaped.

The previously described self-converging display system requires precise positioning and adjustment of the yoke on the kinescope neck in order to produce an accurately converged raster. Final adjustment of the X-Y position of the yoke may be accomplished by actual X-Y yoke movement using an adjustment device such as disclosed in U.S. Pat. No. 3,950,720, issued Apr. 13, 1976 in the name of T. M. Shrader and entitled "Adjustable Spring Mount for a Cathode Ray Tube Yoke". Adjustment of the yoke may also be made by clamping the yoke to the tube at the front or back of the yoke and tilting the free end to simulate X-Y motion of the yoke.

It is important that the undeflected electron beams strike the kinescope display screen substantially on the horizontal center line of the screen. If this does not occur, problems in adjustment of the yoke may result. For example, there may be insufficient tilt range of the yoke to properly converge the beams if significant miscentering should occur. Also, miscentered beams may result in assymetrical correction of beam misconvergence when the yoke is adjusted, so that acceptable overall convergence is difficult to achieve. Also, the raster produced by the deflected beams may not be centered vertically, and may not extend to the top or bottom edges of the screen.

In order to provide individual beam purity and convergence of the undeflected electron beams at the center of the display screen, i.e., static convergence, it is known to place a magnetic apparatus on the tube neck near the rear of the yoke. This "beam bender" may take the form of a number of multipoled magnetic rings which may be rotated to alter the strength and orientation of the magnetic fields generated by the rings in order to achieve good beam purity and accurate center or static convergence. To reduce the costs associated with the use of discrete ring-type beam benders, a flexible strip of magnetizable material may be placed around the neck of the tube behind the yoke. A magnetizing apparatus incorporating magnetizing coils is temporarily placed adjacent to the strip. The coils are energized to create magnetized zones in the magnetic strip which simulate the magnetic poles of the discrete rings. The strength of the magnetic fields created in the zones may be controlled to provide the required beam adjustments.

It is known that color purity adjustment may be made by the use of a two-pole magnetic field with the poles located above and below the horizontal in-line beam axis. These poles may be incorporated as magnetized zones in the strip or sheath beam bender previously described by a method such as that described in U.S. Pat. No. 4,159,456, issued in the name of J. L. Smith and entitled "Magnetizing Apparatus and Method for Use in Correcting Color Purity in a Cathode Ray Tube and Product Thereof", and herein incorporated by reference. As described in the Smith patent, the purity correcting magnetic field must form a pincushion-shaped field in the vicinity of the electron beams in order to provide uniform lateral shift of the three electron beams. The degree of pincushioning of the field is determined by the size of the magnetized zones. The field will become more pincushion-shaped as the zones extend closer to the plane in which the in-line beams lie. If the zones extend too close to the in-line beam plane, the pincushion component of the purity-correcting field may become too great, resulting in unequal shift of the three beams during color correction. It is therefore important to control the size of the purity-correcting magnetized zones in order to insure optimum color purity of the scanned raster.

SUMMARY OF THE INVENTION

The present invention is directed to the use of oppositely polarized magnetic zones in conjunction with a strip or sheath-type beam bender in order to effect vertical electron beam movement. The magnetized zones are located on opposite sides of the kinescope neck and are aligned with the plane of the in-line electron beams. The magnetized zones for effecting vertical beam movement are also located on the beam bender strip between the color purity-correcting magnetized zones in order to keep the amount of magnetizable material used to a minimum.

In accordance with the present invention, a television display system incorporates a kinescope having a display screen and an electron gun assembly disposed within a neck of the kinescope for producing three electron beams aligned along a horizontal axis plane. A deflection yoke is provided for deflecting the beams to form a raster on the display screen. Means for effecting movement of the beams comprises a strip of magnetizable material disposed about the neck and encircling the beams. The strip incorporates a pair of oppositely polarized magnetized zones located on opposite sides of the neck and localized in the vicinity of the horizontal axis plane of a predetermined strength for adjusting the vertical position of the beams on the display screen.

BRIEF DESCRIPTION OF THE DRAWING

In the accompanying drawing.

DETAILED DESCRIPTION

Figure 1:
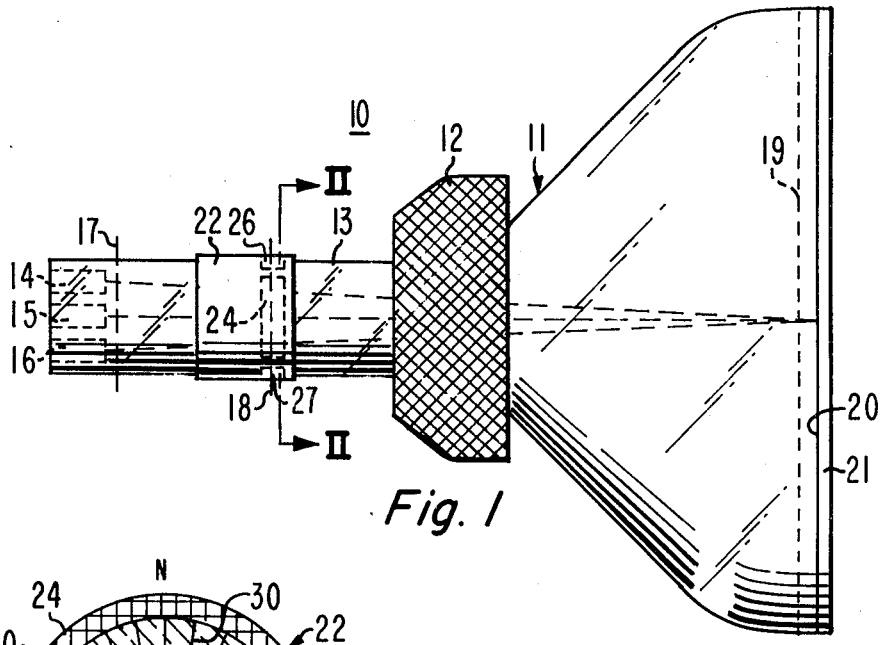
FIG. 1 is a top plan view of a television receiver display system incorporating a strip-type beam bender in accordance with the present invention.

Referring to FIG. 1, there is shown a television receiver display system 10 comprising a kinescope 11 and a deflection yoke 12 mounted on the neck 13 of kinescope 11. Kinescope 11 illustratively includes three electron guns, designated 14, 15 and 16 for producing the red-green and blue-designated electron beams 14*a*, 15*a* 16*a*. The guns 14, 15 and 16 are aligned along a horizontal axis 17 of neck 13. The electron beams pass through an aperture mask or grid 19 and impinge upon a phosphor display screen 20 deposited on a faceplate 21 of kinescope 11. The electron beams are deflected by magnetic fields produced by the horizontal and vertical windings of yoke 12 to form a raster on the display screen 20.

Display system 10 also comprises a magnetizable strip or sheath 22 disposed on neck 13 of kinescope 11 near the rear of deflection yoke 12. Strip 22 may be wrapped around neck 13 and the ends of strip 22 meet at a junction 23 (shown in FIG. 2) or a small gap may be left between the ends of strip 22 to avoid overlapping. The composition of the magnetic material for strip 22 may be conventional barium ferrite mixed in a rubber or plastic binder material. Strip 22 may be held to neck 13 via a piece of nonmagnetic tape.

Strip 22 incorporates magnetized zones to provide electron beam center or static convergence and optimum color purity. Color purity is obtained by creating permanently magnetized regions or zones 24 and 25 (shown in FIG. 2) of appropriate polarity and pole strength in a portion of strip 22. Zones 24 and 25 are located in the vicinity of a longitudinal plane 18 through neck 13. These regions produce a color purity magnetic field in the interior of the tube neck 13 in order to move the three electron beams onto their respective color producing phosphors. The orientation and operation of the color purity magnetized zones will be explained in more detail below.

In accordance with the present invention, strip 22 also incorporates magnetized regions or zones 26 and 27 located in the vicinity of a plane passing through the electron beam horizontal axis 17 for providing vertical movement of the three electron beams.

The magnetized regions 24 and 25 of the magnetic strip 22 will produce field lines 30 having a generally vertical direction in the region intersecting the beams 14*a*–16*a*. The field lines produce horizontal forces and motions 31, 32 and 33 for establishing the color purity of the three in-line beams.

Figure 2:
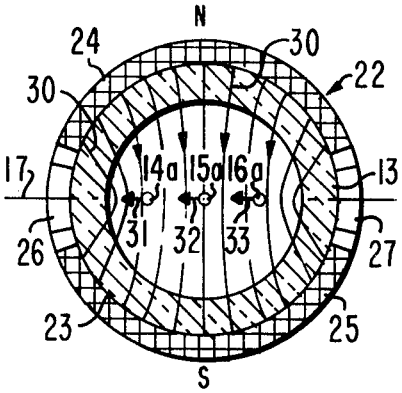
FIG. 2 is a cross-sectional elevational view of a portion of the display system shown in FIG. 1, taken along line II—II, illustrating the operation of the beam bender color purity correcting magnetized zones.

The interior magnetic field in a plane perpendicular to the central axis, becomes a pincushion-shaped field, that is, a field that increases in intensity along the line of deflection of the central beam, as illustrated in FIG. 2. Such a field is desirable to offset the barrel shaped fields produced by magnetic strip 22 in planes perpendicular to the tube central axis but located at some distance from the strip 22.

The size of the regions or zones 24 and 25 determines the degree of pincushioning of the purity correcting field. It can be seen in FIG. 2 that the closer zones 24 and 25 extend toward the horizontal axis plane, the stronger the pincushion component of the purity field becomes. Too great a pincushion component causes unequal or nonuniform shift of the electron beams, thereby causing difficulty in optimizing purity and beam register tolerance. For example, if the zones 24 and 25 extend to within 20° of the horizontal axis 17, a sufficient pincushion-shaped field is formed in the interior of neck 13 in order to provide satisfactory purity adjustment.

Figure 3:
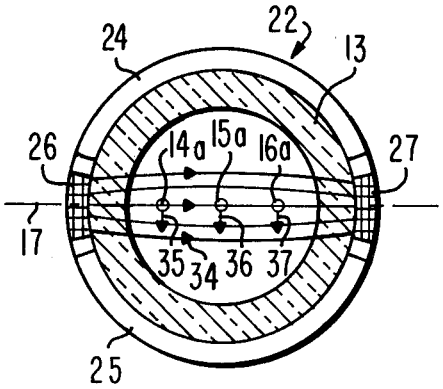
FIG. 3 is a cross sectional elevational view of a portion of the display system shown in FIG. 1, also taken along line II—II, illustrating the operation of the beam bender vertical beam movement magnetized zones.

FIG. 3 shows magnetized zones 26 and 27, which occupy the otherwise unmagnetized portion of strip 22 between magnetized zones 24 and 25 in plane 18. For illustrative purposes, zone 26 is designated as a north pole and zone 27 is designated as a south pole. Magnetic field lines, designated 34, extend between zones 26 and 27 to produce force components 35, 36 and 37 on beams 14*a*, 15*a* and 16*a* causing the electron beams to be shifted downward slightly on the display screen 20. Of course, reversing the polarity of zones 26 and 27 would cause the beams to be shifted upward. The strength of the magnetic field represented by field lines 34 determines the amount of beam shift. The presence of zones 26 and 27 allows for vertical centering of the electron beams, so that problems in yoke adjustment such as limited yoke tilt range and assymetrical top-to-bottom convergence adjustment are reduced. By locating zones 26 and 27 between zones 24 and 25 in the vicinity of the same longitudinal plane 18 of strip 22, the width of strip 22, and hence its cost, need not be increased. The remaining space available on strip 22, as can be seen in FIG. 1, may be used in order to provide beam static convergence via magnetized zones which produce 4 and 6 pole magnetic fields, such as disclosed in U.S. Pat. No. 4,162,470, issued to J. L. Smith, and entitled "Magnetizing Apparatus and Method for Producing a Statically Converged Cathode Ray Tube and Product Thereof", and herein incorporated by reference.

Figure 4:
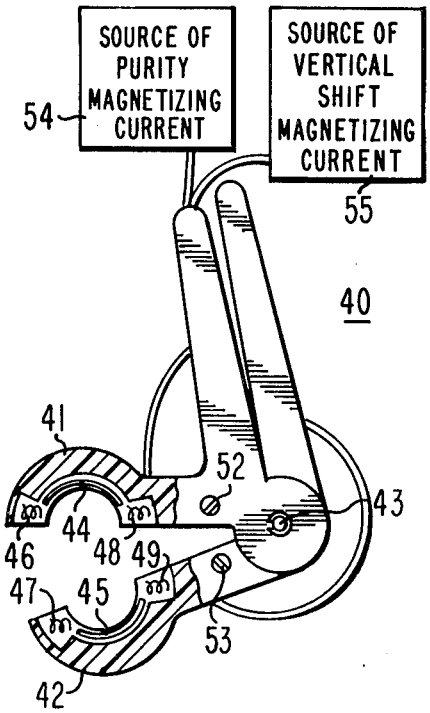
FIG. 4 is an elevational view of a beam bender magnetizing apparatus partially in cross section, together with a block diagram representation of the electrical connections thereto, illustrating the placement of the zone magnetizing coils.

FIG. 4 illustrates an apparatus 40 which could be used for magnetizing the previously described regions or zones 24, 25, 26 and 27. The apparatus 40 is a hinged-jaw magnetizing unit such as described in a copending U.S. patent application Ser. No. 244,664, in the names of C. W. Key et al. and entitled "Apparatus for Influencing Electron Beam Movement" and herein incorporated by reference. Apparatus 40 comprises a pair of semicircular magnetizing head portions 41 and 42 which encircle the tube neck 13 over strip 22. Head portions 41 and 42 are pivotable about hinge 43 in order to place apparatus 40 in magnetizing position on the tube neck quickly and easily. Head portions 41 and 42 are illustrated partially in cross section. Located within head portions 41 and 42 are purity-related magnetizing coils 44 and 45, and beam movement coils 46, 47, 48 and 49. When in position on tube neck 13, coils 44 and 45 are positioned adjacent to the desired location of zones 24 and 25, while coils 46, 47 and coils 48 and 49 are positioned adjacent to the desired locations of zones 26 and 27, respectively. The coils are properly oriented with respect to beams 14*a*, 15*a* and 16*a* via indexing posts 52 and 53 on apparatus 40 which mate with appropriate members on kinescope neck 13 or deflection yoke 12. Purity-related magnetizing coils 44 and 46 comprise elongated loops of wire which extend tangentially along the periphery of neck 13. Current flowing in coils 44 and 45 produce the desired polarity zones 24 and 25 in strip 22. Coils 46–49 are individually-wound solenoid-type coils such as described in the previously referenced U.S. Pat. No. 4,162,470. Coils 46 and 47 are wound to produce a magnetic field of one polarity to form zone 26, while coils 48 and 49 are wound to produce a field of opposite polarity which forms zone 27. Coils 46, 47, 48 and 49 may be wound in series. Current for coils 44 and 45 is provided by a source of purity magnetizing current 54, while current for coils 46–49 is provided by a source of vertical shift magnetizing current 55. A single source of current with means for switching between coil groups may be used. The amount of current in the coils is adjusted to provide the desired beam movement. The current is then removed, leaving magnetized zones 24, 25, 26 and 27 to provide the desired correcting fields.

What is claimed is:

1. In a television display system incorporating a kinescope having a display screen and an electron gun assembly disposed within a neck of said kinescope for producing three electron beams aligned along a horizontal axis plane, means for effecting movement of said beams comprising:

a strip of magnetizable material, disposed adjacent said kinescope neck and encircling said beams, said strip incorporating a first set of magnetized zones for producing substantially only purity correction of said beams, and incorporating a second set of magnetized zones for producing substantially only vertical position adjustment of said beams on said display screen, said first and second sets of magnetized zones being located in a common longitudinal plane through said kinescope neck.

2. The arrangement defined in claim 1, wherein said first set of magnetized zones are oppositely polarized and located on opposite sides of said kinescope neck orthogonal to said horizontal axis plane and said second set of magnetized zones are oppositely polarized and located on opposite sides of said kinescope neck in the vicinity of said horizontal axis plane.

3. A method for adjusting the vertical position and providing purity correction of a plurality of electron beams on the display screen of a kinescope having an electron gun assembly within the neck of said kinescope for producing said three electron beams aligned with a horizontal axis plane comprising the steps of:

mounting a strip of magnetizable material adjacent the neck of said kinescope and encircling said beams;

placing first and second electrical coils adjacent to said strip on opposite sides of said neck in the vicinity of said horizontal axis plane;

placing third and fourth electrical coils adjacent to said strip on opposite sides of said neck orthogonal to said horizontal axis plane in the same longitudinal plane as said first and second electrical coils; and causing current to flow through said coils in such a manner to form oppositely polarized localized magnetized sones in said strip in the vicinity of said first and second electrical coils for producing substantially only vertical position adjustment of said beams and in the vicinity of said third and fourth electrical coils for producing substantially only purity correction of said beams.

4. An apparatus for magnetizing a strip of magnetizable material disposed adjacent the neck of a kinescope which incorporates means for producing three electron beams aligned with a horizontal axis plane, in order to effect vertical movement and purity correction of said beams on a display screen of said kinescope comprising:

means incorporating first and second pairs of electrical coils, adapted to be disposed on said kinescope neck with said coil pairs adjacent to said strip and located on opposite sides of said neck, one of said coil pairs located in the vicinity of said horizontal axis plane and the other of said coil pairs located orthogonal to said horizontal axis plane;

a source of current; and means for applying said current to said coil pairs in such a manner to produce a magnetic field which magnetizes a portion of said strip in order to create oppositely polarized localized magnetized zones on opposite sides of said neck in the vicinity of said horizontal axis plane, and orthogonal to said horizontal axis plane, said zones located in the same longitudinal plane through said kinescope neck.

* * * * *